United States Patent [19]

Masuda et al.

[11] 4,243,313

[45] Jan. 6, 1981

[54] IMAGE FORMING DEVICE

[75] Inventors: Shunichi Masuda, Tokyo; Katsuichi Shimizu, Hoya, both of Japan

[73] Assignee: Canon Kabushiki Kaisha, Tokyo, Japan

[21] Appl. No.: 966,748

[22] Filed: Dec. 5, 1978

[30] Foreign Application Priority Data

Dec. 6, 1977 [JP] Japan ..... 52/146928

[51] Int. Cl.[3] ..... G03G 15/00

[52] U.S. Cl. ..... 355/14 R; 355/3 SH; 355/14 CU

[58] Field of Search ..... 355/14 R, 14 CU, 3 SH, 355/16, 3 R

[56] References Cited

U.S. PATENT DOCUMENTS

| | | | |
|---|---|---|---|
| 3,512,885 | 5/1970 | Osborne et al. | 355/14 CU |
| 3,813,157 | 5/1974 | Fantozzi | 355/14 CU |
| 3,851,966 | 12/1974 | Reehil | 355/14 R |
| 3,944,794 | 3/1976 | Reehil | 355/14 R |
| 3,999,851 | 12/1976 | Sakamaki et al. | 355/14 R |

*Primary Examiner*—R. L. Moses

*Attorney, Agent, or Firm*—Fitzpatrick, Cella, Harper & Scinto

[57] ABSTRACT

An image forming device constructed with a processing device to form an image on a recording material, a first control device to operatively control the processing device so as to continuously form an image on the recording material, a sensing device to detect any disorder within the image forming device, and a second control device corresponding to the sensing device, which enables, on the one hand, operation of the processing device to be interrupted when the disorder occurs, and, on the other hand, the control operation of the first control device to be continued.

44 Claims, 10 Drawing Figures

IMAGE FORMING DEVICE

BACKGROUND OF THE INVENTION

This invention relates to an image forming device such as a reproduction machine, etc.

A conventional reproduction apparatus is so designed that, when jamming of feed paper takes place in the machine, a sorter and other related devices operated along with the reproduction apparatus are stopped, and the power source for the reproduction machine is totally interrupted by a switch provided on the side plate, or door, of the reproduction apparatus to be opened at the time of removing the paper jamming so that the work may be carried out safely.

In view, however, of the recent trend that setting and counting of the number of repetitive reproduction operations are carried out by an electronic expedient, there inevitably arises such inconvenience that, when the side door is opened during the continuous reproduction operation, when paper is jammed in the machine, the set number of the reproduction and the reproduced number as indicated are totally cancelled, and the subsequent reproduction operation cannot be done smoothly. Besides such paper jamming, whenever the side door is opened during the reproduction operation, the numerical values as displayed are entirely crossed out to hinder resumption of a smooth reproduction operation. Further, since the control section of the reproduction apparatus starts and stops its operation by on-off operations of the main switch and the side door switch, it is difficult to control the apparatus without regard to the main switch, hence various inconveniences have been encountered in the use of the reproduction apparatus.

SUMMARY OF THE INVENTION

It is therefore an object of the present invention to provide an image forming device free from the abovementioned inconveniences.

It is another object of the present invention to provide an image forming device capable of easily removing or rectifying any disorder in the machine such as paper jamming, etc. during the repetitive reproduction operation, which requires interruption of such image forming operation.

It is still another object of the present invention to provide an image forming device capable of smoothly resuming the image forming operation after removal of the abovementioned disorder from the machine.

It is another object of the present invention to provide an image forming device capable of executing smooth resumption of the image forming operation when the power source switch is turned on from its off state.

It is still another object of the present invention to provide an image forming device capable of interrupting the subsequent reproduction operation when the recording material is jammed within the machine during execution of the image formation, and of maintaining the control power source in "on" state thereafter, even when the power source switch is turned off.

It is a further object of the present invention to provide an image forming device which is so constructed that the power source switch is turned off when the paper jammed inside the machine is removed, and electric conduction to the component elements of the machine such as an image fixing heater, a high tension transformer for a charger, etc., which are liable to cause danger, is interrupted when the side plate, or door, of the device is opened.

It is a still further object of the present invention to provide an image forming device capable of counting and memorizing the number of paper every time it is jammed in the machine.

It is an additional object of the present invention to provide an image forming device capable of subtracting from the set number of reproduction papers the number of the paper jammed in the machine, and of setting the remaining number of reproduction sheets at the time of resuming the reproduction after removal of the jam.

It is still an additional object of the present invention to provide an image forming device capable of displaying, during removal of the jam, the location of the paper jam, the set number of reproduction sheets, the remaining number of reproduction sheets, and so on.

It is moreover an additional object of the present invention to provide an image forming device capable of detecting the operational condition of the power source switch so as to control the operation of the control section.

It is further object of the present invention to provide an image forming device capable of switching over the power source line to another line at the time of machine disorder such as paper jamming.

DESCRIPTION OF PREFERRED EMBODIMENTS

Figure 1:
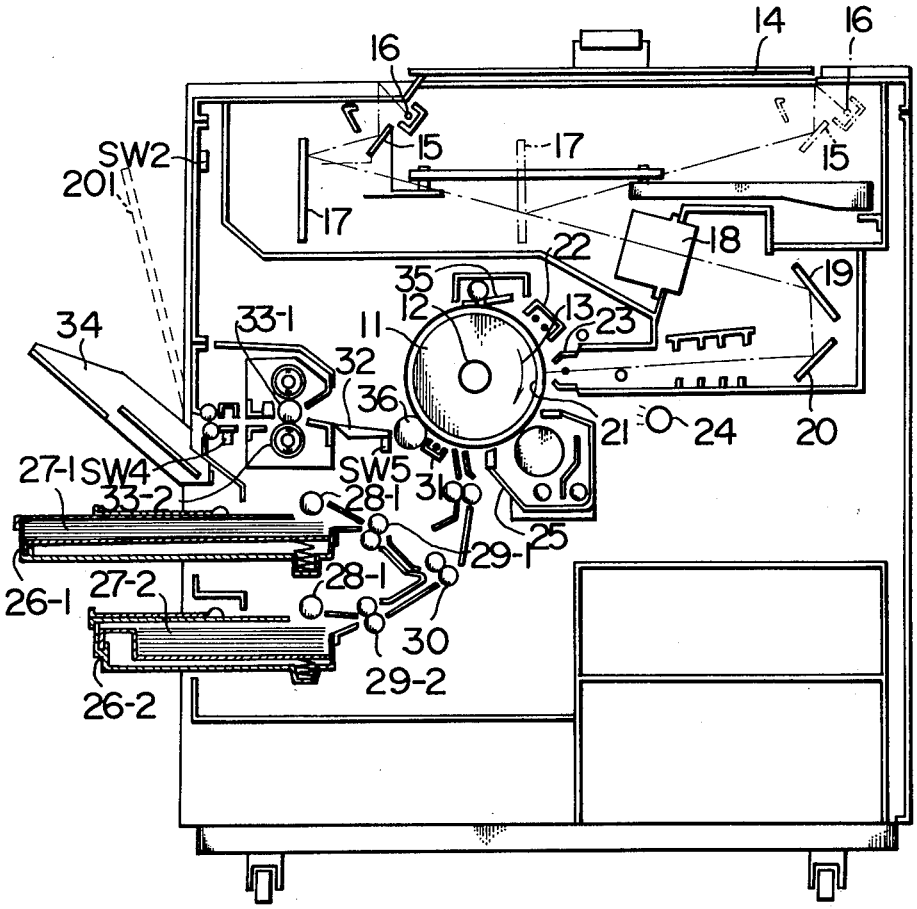
FIG. 1 is a cross-sectional view of a reproduction apparatus, to which the present invention is applicable.

FIG. 1 shows a side elevational view in cross-section of the reproduction apparatus in the present invention.

The surface of a drum 11 consists of a photosensitive body in three-layered structure using CdS photo-conductive substance. The drum is rotatably held on a shaft 12, and is rotated in the direction of an arrow 13 in accordance with a copy instruction.

When the drum 11 rotates to a predetermined position, an image original placed on a glass plate 14 of an image mounting table is irradiated by an illuminating lamp 16 as an integral part of a first scanning mirror 15, and the reflected light is scanned by the first scanning mirror and a second scanning mirror 17. The first scanning mirror 15 and the second scanning mirror 17 move at a ratio of 1:½, whereby the image original is scanned with the light path length in front of a lens 18 being maintained constant.

The reflected light image passes through the lens 18 and a third mirror 19, after which it is focussed on the drum 11 at its exposure section 21 through a fourth mirror 20.

After the drum 11 is charged (in positive (+), for example) by a primary charger 22, it is subjected to a slit-exposure of an image irradiated by the illuminating lamp 16 at the abovementioned exposure section 21. At the same time, charge removal in a.c. or a polarity opposite to that of the primary charge (in negative (−), for example) is carried out by a charge remover 23. Thereafter, the drum 11 is subjected to an overall exposure by an overall exposure lamp 24 to form thereon an electrostatic latent image of a high image contrast. This electrostatic latent image on the photosensitive drum 11 is then rendered visible as a toner image by means of a developer 25.

Image transfer paper 27-1 or 27-2 in a cassette 26-1 or 26-2 is fed into the image forming device by means of a paper feeding roller 28-1 or 28-2, and forwarded in the direction of the photosensitive drum 11 with an approximate timing being taken by the first pair of register rollers 29-1 or 29-2, and then with accurate timing being taken by the second pair of register rollers 30. This operation can be executed by a switch to be turned on by shifting of an optical system provided in its moving path. Subsequently, the toner image is transferred onto the surface of the image transfer paper 27 on the drum 11 while it is passing through a space between an image transfer charger 31 and the drum 11.

After completion of the image transfer operation, the image transfer paper is guided to a conveyor belt 32, and then led to a pair of image fixing rollers 33-1 and 33-2 where the image thereon is fixed under pressure and heat. Finally, the image-fixed paper is discharged into a paper receiving tray 34.

After completion of the image transfer operation the surface of drum 11 is cleaned by a cleaning device 35 constituted with a resilient blade to be ready for the subsequent reproduction cycle.

At the time of paper feeding, if the image transfer paper is biased or twisted after it leaves the paper cassette, the image transfer paper does not wedge into various conveying rollers such as rollers 29-1, 29-2, 30, 36, and so forth, and there occurs from time to time jamming of the paper in the vicinity of the rollers. In particular, when it is wound around the image fixing roller 4 and is not discharged outside, there is a danger of fire.

In order therefore to detect jamming of the image transfer material, the reproduction apparatus according to the present invention is so designed that paper detecting microswitches SW4 and SW5 are provided in the vicinity of an exit of the paper conveying path. By detecting whether these detectors operate at a predetermined time, or not, presence of the jamming is discriminated. When the detectors do not detect movement of the paper, a warning is displayed by display means to indicate the occurrence of a jam. A check signal at this predetermined time is a timing signal which has been programmed in advance in a process sequence control circuit.

Figure 2:
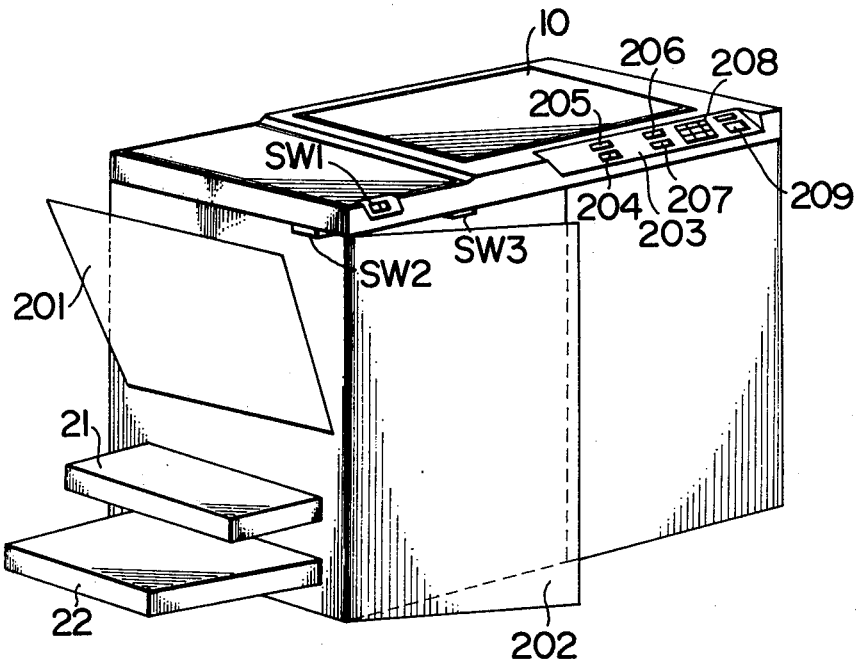
FIG. 2 is a perspective view of the reproduction apparatus shown in FIG. 1.

FIG. 2 is a perspective view of the reproduction apparatus shown in FIG. 1, in reference to which removal of the paper jamming will be explained hereinbelow.

In the drawing, a reference numeral 201 designates an opening and closing door to remove paper which is jammed in the vicinity of the image fixer; 202 refers to another opening and closing door to remove paper which is jammed in the vicinity of various conveying rollers; 203 an operating panel for reproduction instruction; 204 and 205 indicators which indicate the location of the jam; SW1 an alternating current supply switch; and SW2 and SW3 door switches to be turned on by closing of the respective doors 201 and 202, and turned off by their opening. A reference numeral 206 designates an indicator to indicate the number of the reproduction sheet which has been input by a numerical key 208. A numeral 207 refers to another indicator to indicate the number of reproduced copies. 209 represents a copy button to start the copying process. The other components are exactly the same as those in FIG. 1.

Now, if the paper jam takes place in the vicinity of the rollers 29, 30, and 36, and the switch SW5 does not detect the paper within the first predetermined time, a non-detection signal is introduced as an input into the control circuit, and an output jam signal is produced, by which output signal the indicator 204 is lit to indicate that the paper jam should be removed by opening the door 202. When the jam takes place in the vicinity of the fixing device, and the switch SW4 does not detect the paper within the second predetermined time, the jam signal output is produced in the same manner, by which output signal the indicator 205 is lit to indicate that the disorder should be removed by opening the door 201. Accordingly, the jam removal is remarkably facilitated and the copying operation can be re-started smoothly.

When the door 201 or 202 is opened, electric conduction to the alternating current loads such as the drive motor for the conveying rollers, the heater for the fixing device, the high tension transformer, and so on is interrupted by the turn-off of the switch SW2 or SW3. When the jam signal is generated, the direct current power source to the control circuit is switched over to an independent line from the circuit system of the door switches and the main switch. As a result, the control circuit is in its operative state even during removal of the jammed paper, and continues to memorize the set number of reproduction sheets as well as the number of the reproduced sheet as electronically stored therein without cancelling them, these numerical figures being continued to be indicated on the displays 206 and 207, respectively. The number of the sheet of the jammed paper is subtracted from the total number of the reproduced sheets and is indicated on the indicator 207 after the doors 201 and 202 are closed subsequent to removal of the jammed paper. Consequently, the reproduction operation can be continued smoothly thereafter.

Figure 3:
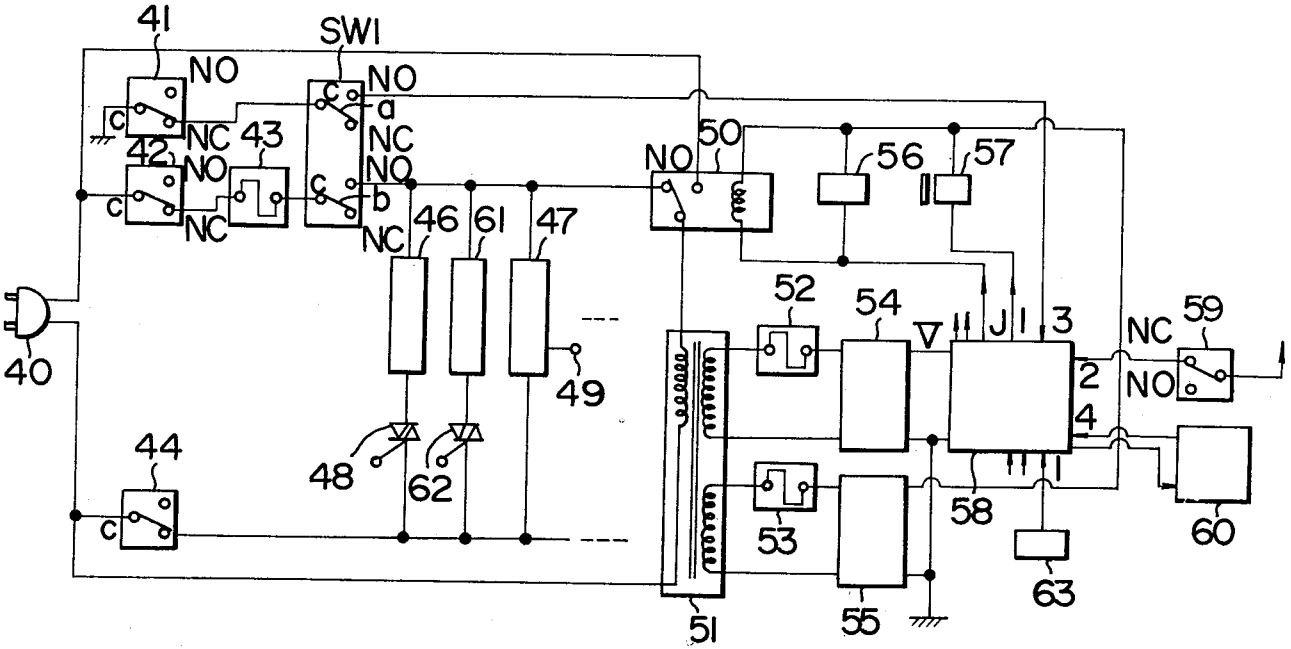
FIG. 3 is one embodiment of the control circuit according to the present invention.

FIG. 3 illustrates one actual embodiment of the control circuit described in the foregoing. In the drawing, a reference numeral 40 designates a plug for taking commercial electric supply. One of the lines from the plug 40 is connected to a terminal C of a micro-switch 42 operatively associated with the door switches SW2 and SW3 and a terminal NO of a relay 50. The other line of the plug 40 is connected to a terminal C of a micro-switch 44 also operatively associated with the door switches SW2 and SW3. A terminal NC of the micro-switch 42 is connected to the terminal C of a contact b in the main switch SW1. A micro-switch 41 operates in association with the micro-switches 42 and 44, and a terminal C thereof is connected to the ground and a terminal NC thereof is connected to the terminal C of a contact a in the main switch SW1, and further to the control circuit 58. A terminal NO of the contact b of the main switch SW1 is connected to the primary side of the low-tension transformer 51 through various loads such as a main motor 46 to drive the reproduction apparatus, a high tension transformer 47, etc. as well as through the contact of the relay 50. One of the terminals of the secondary winding of the low tension transformer 51 is connected to a d.c. power source 54 for the control circuit through a breaker 52, and the other terminal thereof is connected to a d.c. load power source 55 through another breaker 53 in the same manner as above.

The motor 46 is to move the photo-sensitive drum 11, the conveying rollers, the image fixing roller, the lamp 16, and the optical system 15 and 17. The high tension transformer 47 is to actuate the electric chargers 22, 23, and 31. Besides these, the image exposure lamp 16, the overall exposure lamp 24, etc. are provided as the alternating current loads. The control signals for triac 48 and 62 for switching the main motor 46, the heater 61, and the transformer 47 are applied at a predetermined timing from the control circuit 58. The d.c. power sources 54 and 55 are the well known stabilizing power source to rectify alternating current and stabilize the same. The control circuit is one having the well known program memory which produces outputs in the direction of arrows in accordance with input signals in the arrow direction or with the internal program data. A jam counter 56 is a well known mechanical counter which counts up every time a jam takes place, i.e., it counts up the number of papers jammed. A jam solenoid 57 is to connect a reset switch 59 to the NO terminal thereof when paper is jammed, whereby the reset switch 59 is locked mechanically to the side of the terminal NO. In this locked state, no reproduction operation starts, even if the power source is closed and the copy button is turned on after removal of the jam trouble, but it becomes feasible only when the switch 59 is changed over manually to the side of the terminal NC. A reference numeral 60 is a timer for holding d.c. power source to the control circuit 58 for five minutes after occurrence of a paper a jam, and interrupts the d.c. power source when five minutes lapses. The relay 50 changes over the contact to the side of the terminal NO when the jam is detected, thereby changing over the power source line to the transformer 51.

Figure 4:
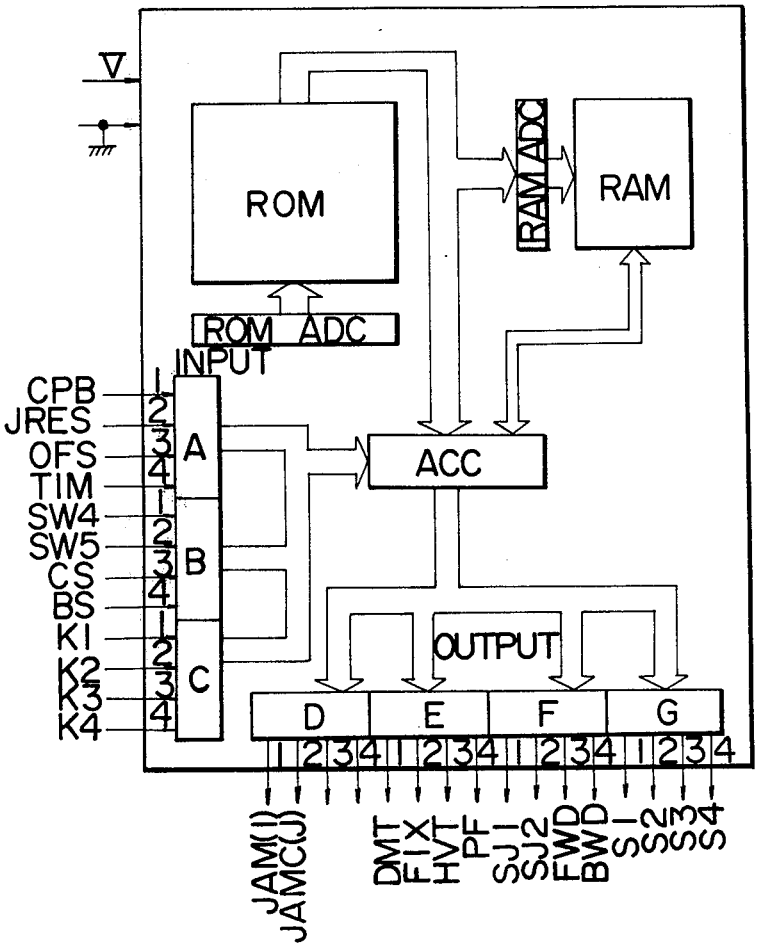
FIG. 4 is a partial circuit diagram in the circuit of FIG. 3.
Figure 5:
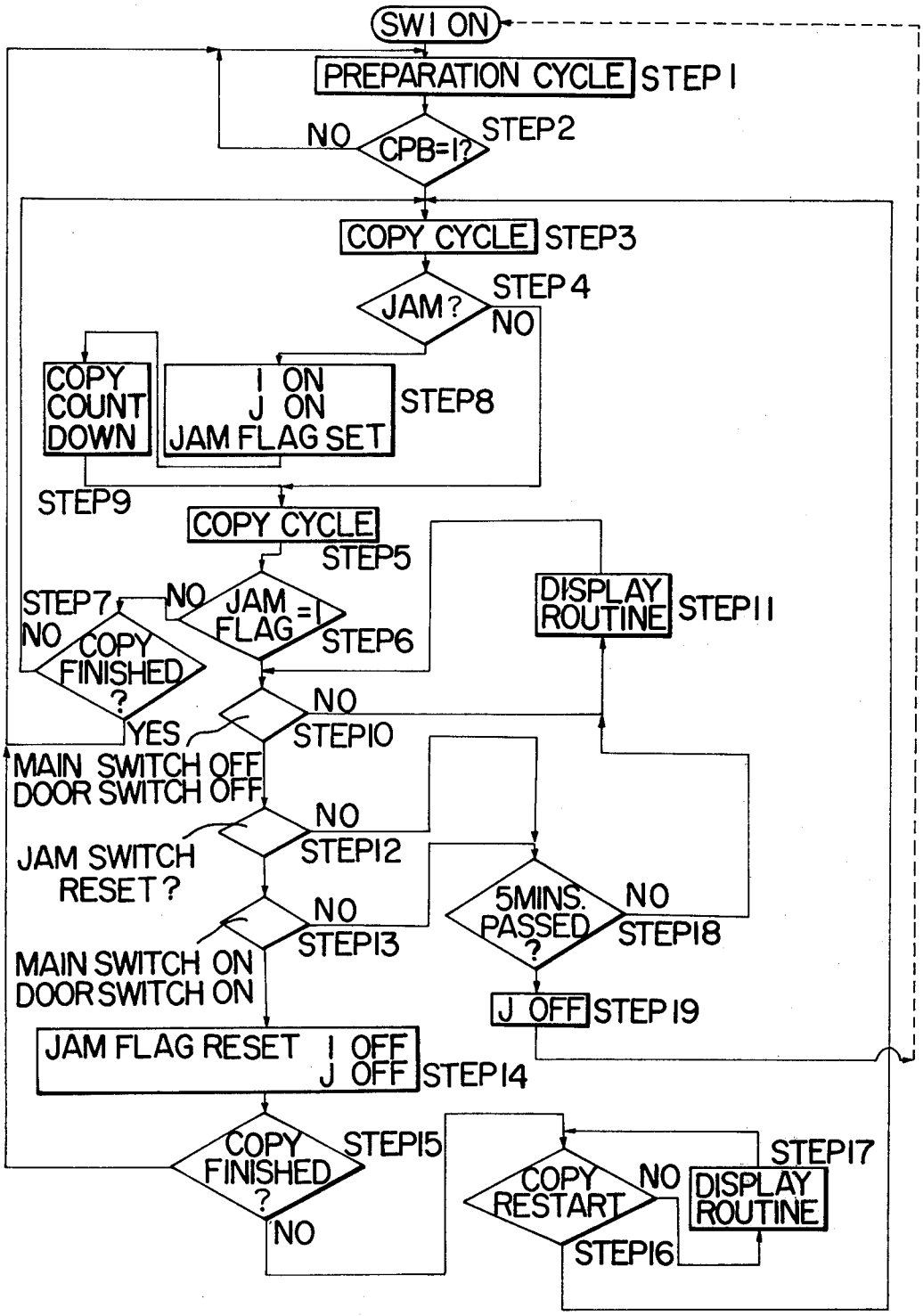
FIG. 5 is a flow chart of the control steps.

Briefly explaining the control circuit in FIG. 4, it comprises a program memory ROM, in which a flow step as shown in FIG. 5 has been programmed beforehand in the form of a binary code; a data memory RAM to store therein program memory data and input signal data such as the number of sheets of reproduction; an input port INPUT to gate-in input signals; an output port OUTPUT to latch output signals; and an accumulator ACC to temporarily store therein data to the output port. It further comprises a decoder to decode the abovementioned binary codes in the program memory ROM and an operational circuit ALU to operate and logically discriminate the data from the program memory ROM, the data memory RAM, and the input and output ports INPUT, OUTPUT. To terminals 1 to 4 of a port A in the input port INPUT, there are introduced various input signals such as a signal CPB which takes a code 1 when the copy button is turned on, a signal JRES which takes a code 1 when the jam reset switch 59 is reset to the side of NC, a signal OFS which takes a code 1 when either the main switch or the door switch is turned off, and a signal TIM which takes a code 1 when the timer lapses five minutes. To terminals 1 and 2 of the port B in this input port INPUT, there is introduced an input signal 1 which is generated by turning on of the switches SW4 SW5.

From terminals 1 and 2 of a port D in the output port OUTPUT, there are produced various output signals such as a jam detection signal JAM (1) to actuate the jam solenoid 57 and the timer 60, and a signal JAMC (J) to actuate the jam counter 56 and the jam relay 50. From terminals 1 to 4 of a port E in this output port, there are produced various signals such as a signal DMT to actuate the motor 46, a signal FIX to turn on the heater 61, a signal HVT to turn on the high tension transformer; and a signal PF to turn on the paper feed starting roller 28.

In this control circuit 58, an input signal is introduced into the accumulator ACC in accordance with the program step, is discriminated for its binary code, 1 or 0, and is forwarded to the next step to latch a predetermined output port, thereby turning the intended load on.

Into terminals 1 to 4 of a port C in the input port, there are introduced input data K1 to K4 resulted from conversion of signals from the numerical key 208 on the operating panel into 4-bit binary decimal codes.

Terminals 1 to 4 of a port G in the output port are to produce 4-bit output data same as the abovementioned code so as to indicate numerals on the well known seven-segment numerical indicators 206, 207. In the case of each indicator having two numerical places, four units of segment indicators are necessary, hence the numerical places can be changed over by a well known method to produce an output.

SJ1 and SJ2 of a port F in the output port are for the jam indication with regard to the switches SW4 and SW5, respectively, which actuate the indicators 205 and 204.

A terminal 3 of the port B in the input port INPUT is for introducing a timing signal CS which takes a code 1 by turning on of the switch to be actuated by a cam provided on the photosensitive drum 11. A terminal 4 of the same port B is for introducing a signal BS1 by turning on of the switch provided at an inverting position in the path and to be actuated by a cam provided in the optical system.

In the following, the operations of the control circuit after closing of the power source switch SW1 will be explained in reference to FIG. 5.

Closure of the main switch SW1 enables electric power from the source to be supplied into the a.c. circuit of the motor 46, the heater 61, the high tension transformer 47, and the low tension transformer 51. By an output from the low tension transformer 51, the control circuit performs step 1 of a preparation cycle. In this preparation cycle, resetting of the whole circuit is first carried out, whereby key entry and numerical indication routine are performed. In other words, the data by the key are introduced into the input port C, stored in address a in the data memory RAM, and the contents thereof are displayed on the indicator 206 through the output port G. Thereafter, the process proceeds to a routine to detect turn-on of the copy button. When the signal CPB discriminates a code 1 in step 2, the process proceeds to the execution step for reproduction cycle, i.e., step 3. In other words, the port E is latched to produce the motor signal output DMT, the heater signal output FIX, and the high voltage signal output HVT, thereby turning the triacs 48 and 62 on to conduct electric current through the motor, the heater and the high tension transformer. The drum performs a predetermined rotation to actuate the cam switch, thereby introducing an input signal CS, and producing a paper feeding output signal PF, and an output signal FWD to turn on the image exposure lamp and the optical system forwarding clutch, as the result of which the paper feeding and the exposure scanning are commenced. The clutch is to convert the rotational force of the motor into the forwarding force. When the exposure is terminated and the optical system reaches its reversing position, a reversing signal output BS1 is produced, and the control circuit 58 takes the output signal therein to turn off the forward clutch and turn on a back clutch, whereby the optical system is subjected to its return motion. Since the drum continues its rotation, there is executed a process of forming a reproduced image on image transfer paper through an image transfer region, and discharging the thus image-transferred paper outside the reproduction apparatus. After this, it enables the port B to perform read-in at each period when the paper will be passing through the switches SW4 and SW5. At the step 4, when the paper detection by the switches SW4 and SW5 are discriminated, it proceeds to step 5. Incidentally, read-in operation by the port B is done by a routine which is so timer-programmed that the paper detection may be performed when a predetermined time will have lapsed from the reversing position. When the paper is detected, it proceeds to the step 5 where the process operations such as turning off of the back clutch, or turning off of the unnecessary high tension transformer with an input of the drum cam, and others are effected, after which is proceeds to step 6. Since a jam flag is in 0, this is discriminated. After this, it proceeds to step 7 where determination is made as to whether the number of the reproduced sheet is equal to the set number of reproduction sheets. If both are equal, it is regarded as termination of the reproduction operation, then the main motor is turned off after the paper discharge, and the process returns to the step 1. In this instance, the jam flag corresponds to the data at the address J in the data memory RAM which stored therein a code 1 when the jam was detected.

At the step 4, when the paper detection is not done, i.e., when the paper jam is discriminated, the output port D is latched at step 8 to produce a jam signal output I and a jam counter and jam relay signal output J, thereby setting the jam flag. Accordingly, the jam solenoid 57 is turned on to change the reset switch 59 over to the side of the terminal NO. Also, the relay 50 is actuated to connect the primary side of the low tension transformer to the plug line, while adding 1 to the counter 56. It proceeds to step 9, and, when the continuous multi-copying operation is to be done, the number of the sheet wasted by the jamming is subtracted from the number of reproduced sheets obtained so far. The continuous reproduction proceeds from step 7 to the step 3. The number of reproduced sheet is memorized in RAM by adding the code 1 to the address b thereof at every time the paper feed signal of the image transfer paper is produced as an output in the step 3. The subtracted number of sheet is also re-stored in the address b. The abovementioned remaining reproduction cycle is carried out in the step 5, and then the process proceeds to step 6. In the step 6, the code 1 of the jam flag is discriminated, and then the process proceeds to step 10. In other words, irrespective of the set number of sheets, no copy cycle thereafter is executed. At this step, there is performed a routine to discriminate whether or not the main switch or the door switch is turned off. Since the switch remains in its "on" state, the port 3 of the computer 58 is grounded through NC of the switch 41 responding to the door switch and the contact a of the main switch SW1, whereby the signal OFS is in 0. Accordingly, the control circuit 58 performs the jam indication routine I, produces the output SJ1 or SJ2 from the port F, and indicates the door opening instructions to remove the paper depending on the location of the jam, as already mentioned in the foregoing. Also, the set number of sheets and the subtracted number of reproduced sheets are displayed. When the door 201 to 202 is opened, the door switch SW2 or SW3 is turned off, whereby the step 10 is skipped. In other words, since the switch 41 is turned off, the input port 3 of the computer 58 becomes 1, by the discrimination of which this step 10 is executed. At this instance, as the switches 42 and 44 are turned off, the a.c. circuit power source is interrupted. The d.c. power source, however, is maintained by the relay 50 as mentioned above. Therefore, there is no possibility of an operator to put his fingers in the conveying system nor to be electrified during the jam removal work. The display of the set number of sheets for the reproduction and the number of reproduced sheet can be also continued during the jam removing work. Incidentally, the display routine of the set number of sheets for reproduction and the number of the reproduced sheet is inserted in the steps 1, 3, 5 and 11, hence it is not particularly shown in the drawing. The numerical display routine is a well known program setp for the segment-indication.

In step 12, discrimination is carried out as to whether the rest switch 59 has returned to the side of NC, or not. After removal of the jammed paper, when the reset switch 59 is reinstated, a code 1 is introduced into the terminal 2 of the port A of the computer 58 as the input JRES. This input is discriminated, and then the process proceeds to step 13 were discrimination is done as to whether the main switch and the door switch are turned on, or not. After turning on of the reset switch, when the door is closed and the main switch SW1 is turned on, the process proceeds to step 14, skipping this step 13. In the step 14, the previously set jam flag is reset, and the output latch of the jam signal I and the jam relay signal J are released. In this consequence, the relay 50 is reinstated, and the driving system of the d.c. power sources 54 and 55 is changed over to the circuit line for the a.c. load from the plug 40. Also, the jam solenoid 57 is reset.

In step 15, coincidence between the set number of reproduction sheets and the number of the reproduced sheet is discriminated as is the case with the step 7. If both numbers are equal, the process returns to the step 1. The process proceeds to step 16 on the way of the continuous reproduction operation, and wait for turning on of the copy button. During this waiting period, the indication routine II in the step 17 is executed, whereby the initial set number of reproduction sheets and the number of reproduced sheets with the number of sheets jammed being deducted therefrom are indicated in the indicators. By turning on of the copy button, the process again proceeds to the step 3 where reproduction of the remaining sheets is carried out.

The jam counter 56 is to store therein the accumulated number of sheets jammed during the reproduction operation, the accumulated number of which will be used as the basis for calculating the rental, examining reliability of the machine, etc. by the servicing company. If no removal of the jammed paper is performed within five minutes after the door is opened subsequent to the occurrence of the jam, the control d.c. power source is turned off. This step will be explained in the following.

In step 13, when both doors are not closed, i.e., the main switch is not turned on, the process proceeds to step 18 where the computer 58 produces a pulse signal output TIM to cause the timer 60 to commence the time-limiting operation. Before the set time is over, the display routine in the step 11 is executed to thereby continue throughout the jam removing work display of the location of the jamming and the number of the reproduction sheet. If no reset switch and entire door switches are turned on, latching of the jam relay signal J is ceased after five minutes, and the relay 50 is turned off to interrupt the low tension transformer, whereby continuous feeding of unnecessary power can be stopped during the jam removing work. In addition, since the process control is done by detecting the state of the door switches and the main switch, it is possible to perform various controls before turning on of the switches.

Figure 7:
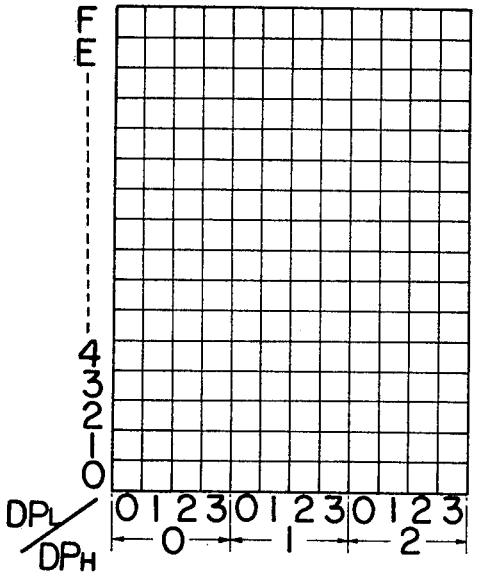
FIG. 7 is a memory area diagram.
Figure 8A:
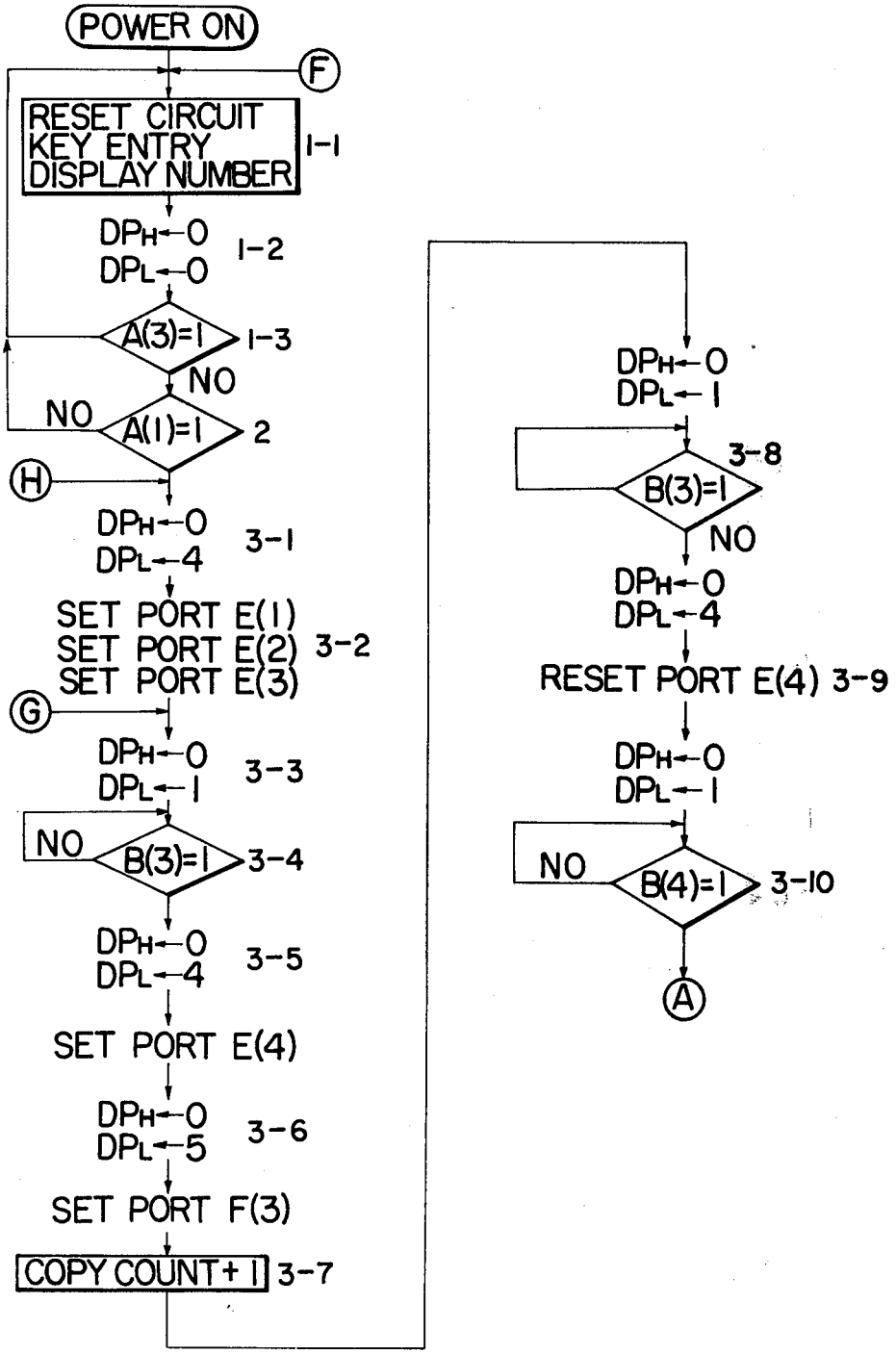
FIG. 8 is another flow chart of the control steps.
Figure 8B:
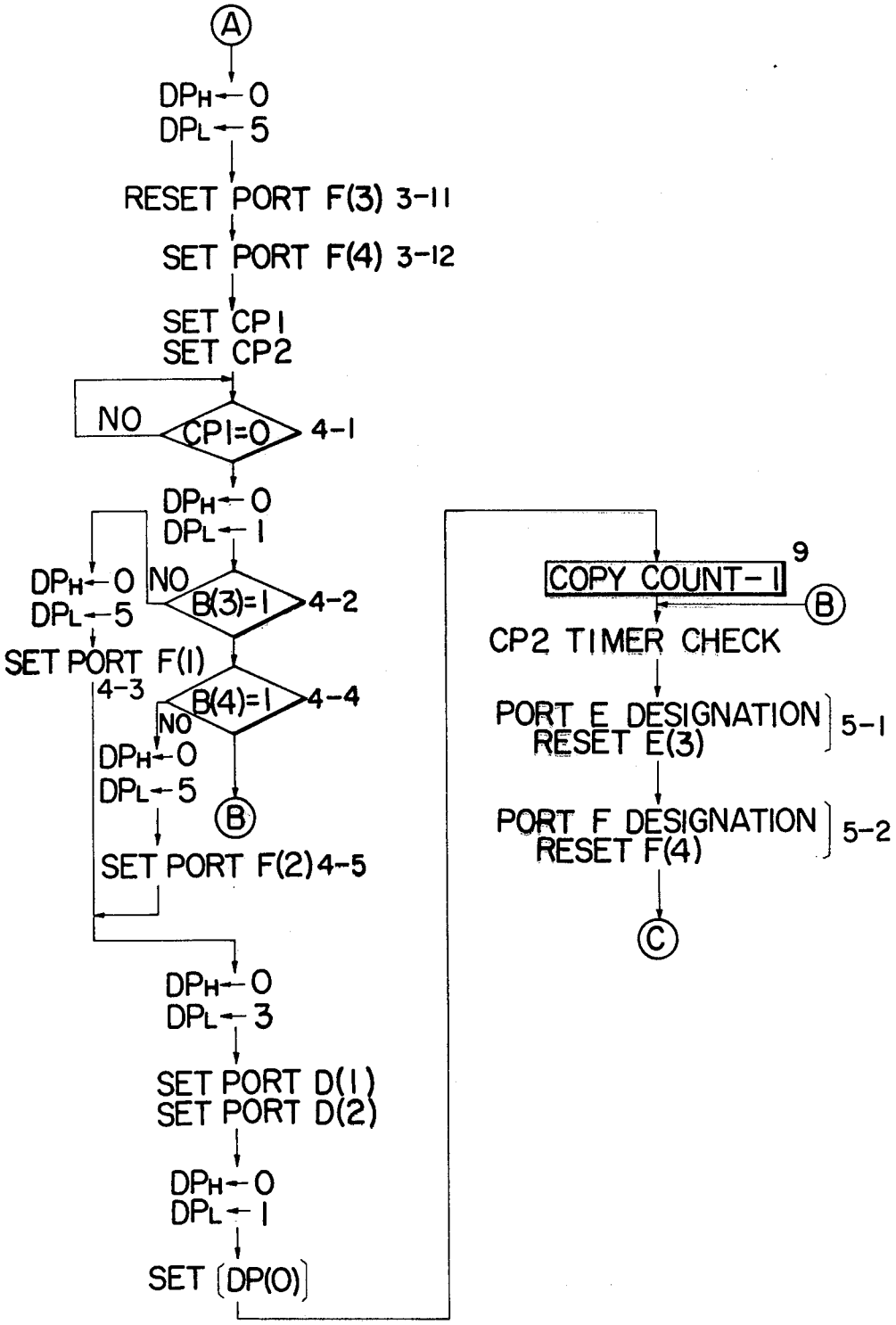
Figure 8C:
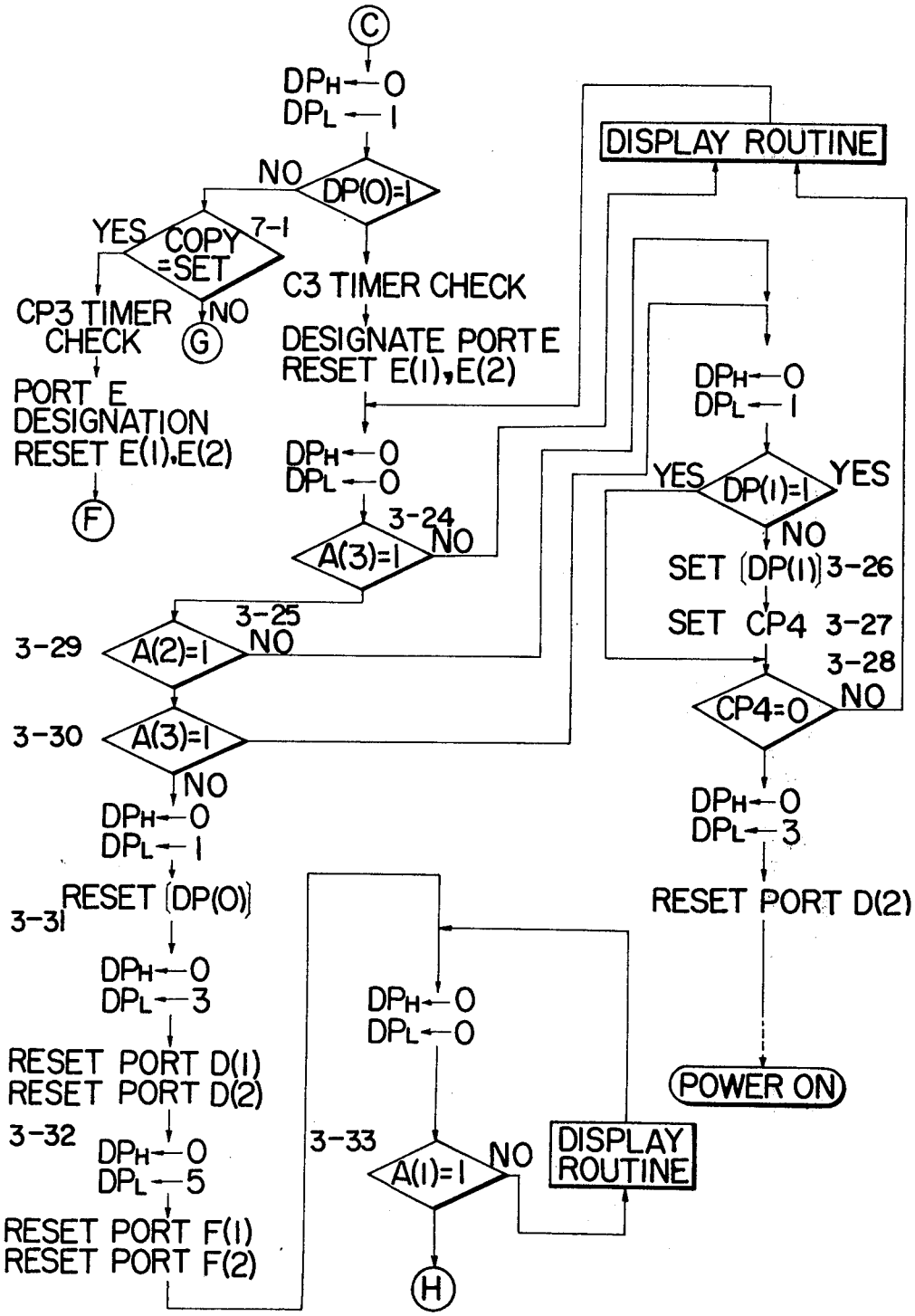

FIG. 8 is one example of a flow chart in the form of word mode when the flow of FIG. 5 is executed by using a microcomputer NPD 547 (a manufacture of Nippon Denki K.K., Japan). Explaining briefly, reference letters $DP_H$ and $DP_L$ in the drawing designate registers existing in CPU to perform the ana designation (FIG. 7) of the memory RAM (FIG. 4) as well as designation of the input and output port of CPU. They are generally called "data pointer". CP1 to CP3 set shows setting of a timer time to execute the timer operation in the CPU in RAM. Machine words with each of the steps in the flow as the basic unit are stored in ROM, and the timer operation is executed by sequential readout of the initial address in ROM after closure of the CPU power source V. The power source switch is turned on, the codes 0,0 are set in the data pointer after execution of the key entry, etc. (1-1) to designate the port A followed by discrimination as to whether the designation is at the third bit of the port, or not (1-2), thereby detecting the state of the door and main switches. When the bit is 0, discrimination is made as to whether the designation is on the first bit of the port A, or not (1-3) to detect the turning on of the copy button (2). When the bit is 1, it proceeds to the copy cycle. The codes 0,1 are set in the data pointer (3-1), the port E is designated, and the code 1 is set in the first to third bit to thereby turn on the main motor, the heater, and the high tension transformer by an output 1 from E(1) to E(3). The codes 0, 1 are set in the data pointer, the port B is designated (3-3), and turning on of the drum cam is detected by discriminating the third bit. Then, in the same manner as described above, a code 1 is produced as an output from the ports E(4) and F(3) to turn on the paper feeding roller, the forward clutch, and the light receiving lamp (3-5, 3-6). At this instance, the copy number counting section in RAM is added with 1 (3-7), and, while detecting turning off of the abovementioned cam switch, the paper feeding roller is turned off (3-9). When the cam provided in the optical system turns on the micro-switch provided in the terminal end of the optical system path, the exposure is stopped, and the returning clutch is actuated (3-12). When a time CP1 for the jam timer and a time CP2 for turning off the back clutch and the high tension transformer are set (4-1), and the jam timer completes the timer operation, if no paper is present at the switch SW4, an output is produced for indicating the location where the jamming occurred (4-3). If the paper is present at the switch SW4 and not at the switch SW5, the port F(2) is set and displayed (4-5). Then, the jam output I and J and the jam flag are set, and the copy number which was previously counted up is reduced by 1 (3-9). Thereafter, completion of the timer operation of the timer CP2 is checked to turn off the clutch and the transformer as is the case with no jamming occurred (5-1, 5-2). In case no jamming occurs, the timer C3 is set, if the previous copy counter is equal to the set counter (7-1), and the drum and the heater are stopped after completion of the timer (7-2). In the case of the jamming, the drum, etc. are stopped in the same manner (3-23), and the operating condition of the switches and the reset switch are discriminated to thereby perform setting and checking of the five-minute timer CP4 (3-24 to 3-28). When the reset switch and the power switches are turned on within five minutes (3-29, 3-30), the jamming is dissolved and the copying process can be resumed (3-31 to 3-33).

Figure 6:
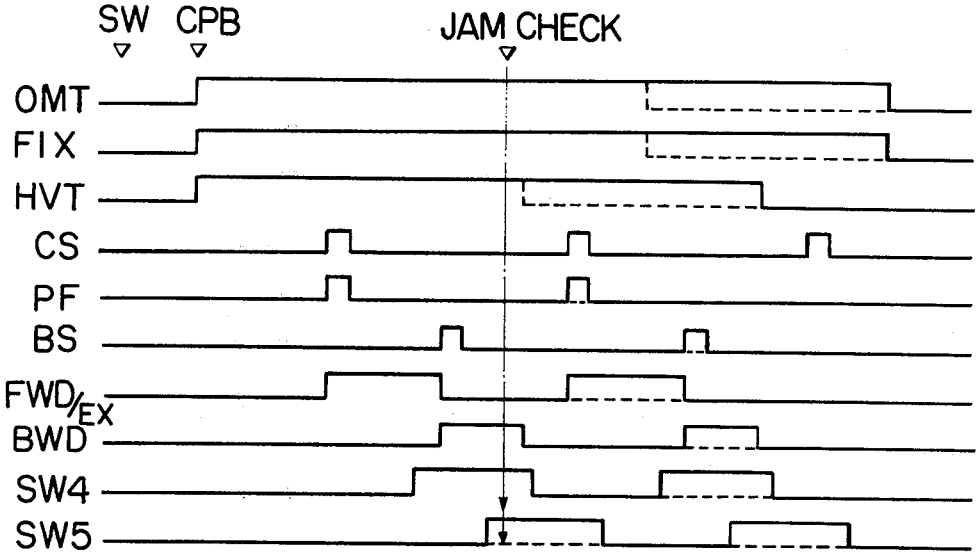
FIG. 6 is an operational timing chart of the reproduction apparatus shown in FIG. 1.

FIG. 6 shows a time chart of a signal "on" at the time of two-sheet copying. The dot line in the chart represents the jamming.

What we claim is:

1. An image forming apparatus, comprising:

process means for forming an image on a recording member;

power switch means for supplying power to said image forming apparatus;

setting means for setting instructions for repetitive image forming operations;

first control means for completing the repetitive image forming operations instructed by said setting means, and for storing and indicating a number relating to the image forming operation; and second control means for turning off the power supply at least for the storing or indicating operation in response to the turning-off of said power switch means before the start or after the termination of the image forming operation, and for maintaining the power supply for the storing or indicating operation despite the turning-off of said power switch means, upon the interruption of the image forming operation caused by trouble in the apparatus.

2. An apparatus according to claim 1 wherein said second control means maintains the power supply for a predetermined period of time.

3. An apparatus according to claim 1, wherein said second control means, to maintain the power supply, supplies the power to said first control means via another power supply line.

4. An apparatus according to claim 1, wherein said first control means includes a computer for executing the image forming process.

5. An image forming apparatus, comprising:

process means for forming an image on a recording member;

first control means for operating said process means to form the image on the recording member and for providing an indicating signal relating to the image forming operation, said first control means including a memory which stores a program for completing the image forming operation; and second control means for detecting trouble relating to the recording member and for interrupting the image forming operation, said second control means, when power supply to said first control means is turned off during an interruption, supplying power to said first control means via another power supply line to store or indicate at least said signal.

6. An apparatus according to claim 5, wherein said second control means includes switch means for supplying power to said apparatus and means for discriminating the state of said switching means by said program.

7. An apparatus according to claim 6, wherein said second control means discriminates, at the time of an interruption, the state of said power switch means to control the possibility of resuming the image forming operation.

8. An apparatus according to claim 6, further comprising means for maintaining the power supply to said first and second control means when trouble occurs in the apparatus despite the off-set of said power switch means.

9. An apparatus according to claim 6, wherein said switch means releases its power supplying action after a predetermined period of time.

10. An apparatus according to claim 6, further comprising means for indicating, upon an interruption, the place where the trouble has occurred.

11. An image forming apparatus, comprising:

process means for forming an image on a recording member;

power switch means for supplying power to said image forming apparatus;

start switch means for starting an image forming operation of said process means;

first control means, responsive to said start switch means, for operating said process means, and, responsive to the occurrence of trouble relating to the recording member, for interrupting the operation of said process means, said first control means including a control circuit having a memory which stores a program for the image forming operation;

lock-release switch means for locking the interruption of said operation and for releasing the locking; and second control means for discriminating the states of said power switch means and said lock-release switch means by said program and for controlling the start of the image forming operation, said second control means including detecting means for detecting the state of said power switch means and means for supplying signals from said detecting means and said lock-release switch means to said control circuit.

12. An apparatus according to claim 11, wherein said second control means discriminates, for its control of said apparatus, the turn-off state of said power switch means.

13. An apparatus according to claim 11, wherein said second control means discriminates, at the time of an interruption, the state of said power switch means to control the possibility of resuming the image forming operation.

14. An apparatus according to claim 11, wherein said second control means discriminates that said power switch means has been turned on again, and then enables said apparatus to resume the image forming operation.

15. An apparatus according to claim 11, wherein said power switch means comprises at least one safety switch and a manually actuatable main switch.

16. An apparatus according to claim 11, further comprising means for indicating, upon an interruption, the place where the trouble has occurred.

17. An apparatus according to claim 11, further comprising setting means for setting instructions for repetitive image forming operations, wherein said second control means controls the indication of the instruction set by said setting means, and a warning of a malfunction.

18. An image forming apparatus, comprising:

process means for forming an image on a recording member;

first control means for operating said process means, and responsive to the occurrence of trouble relating to the recording member, for interrupting the operation of said process means, said first control means including a control circuit having a memory which stores a program for the image forming operation;

lock-release switch means for automatically locking the interruption of the operation upon the occurrence of trouble related to the recording member, and for releasing the locking; and second control means for discriminating the state of said lock-release switch means by said program and for controlling the start of the image forming operation, said second control means including means for supplying a signal from said lock-release switch means to said control circuit.

19. An apparatus according to claim 18, further comprising a power switch means for supplying power to said image forming apparatus, wherein said second control means discriminates, for its control of said apparatus, the turn-off state of said power switch means.

20. An apparatus according to claim 18, further comprising a power switch means for supplying power to said image forming apparatus, wherein said second control means discriminates at the time of an interruption, the state of said power switch means to control the possibility of resuming the image forming operation.

21. An apparatus according to claim 18, further comprising a power switch means for supplying power to said image forming apparatus, wherein said second control means discriminates that said power switch means has been turned on again, and then enabling said apparatus to resume the image forming operation.

22. An apparatus according to claim 18, further comprising a power switch means for supplying power to said image forming apparatus, wherein said power switch means comprises at least a safety switch and a manually actuable main switch.

23. An apparatus according to claim 18, further comprising means for indicating, upon an interruption, the place where the trouble has occurred.

24. An apparatus according to claim 18, further comprising setting means for setting instructions for repetitive image forming operations, wherein said second control means controls the indication of the instruction set by said setting means, and a warning of a malfunction.

25. An image forming apparatus, comprising:

process means for forming an image on a recording member;

first power switch means, manually operable, for supplying power to said image forming apparatus;

second power switch means actuatable in response to opening and closing of an apparatus cover;

start switch means for staring an image forming operation of said process means;

first control means, responsive to said start switch means, for operating said process means, and responsive to the occurrence of trouble relating to the recording member, for interrupting the operation of said process means, said first control means including a control circuit having a memory which stores a program for the image forming operation; and second control means for discriminating the states of said first and second power switch means by said program and controlling the image forming operation, said second control means including detecting means for detecting the states of said first and second power switch means and means for supplying a signal from said detecting means to said control circuit.

26. An apparatus according to claim 25, wherein said second control means discriminates, for its control of said apparatus, the turn-off state of said first and second power switch means.

27. An apparatus according to claim 25, wherein said second control means discriminates, at the time of an interruption, the states of said first and second power switch means to control the possibility of resuming the image forming operation.

28. An apparatus according to claim 25, further comprising means for locking the interruption, and a releasing switch for releasing the locking means, wherein said second control means enables said apparatus to resume the image forming operation in accordance with the state of said first and second power switch means and the state of said releasing switch.

29. An apparatus according to claim 25, further comprising means for indicating, upon an interruption, the place where the trouble has occurred.

30. An apparatus according to claim 25, further comprising setting means for setting instructions for repetitive image forming operations, wherein said second control means controls the indication of the instructions set by said setting means, and a warning of a malfunction.

31. Apparatus according to claim 25, wherein said second power switch means comprises a plurality of safety switches located at different places.

32. An image forming apparatus, comprising:

process means for forming an image on recording member;

power switch means, manually operable, for supplying power to said image forming apparatus;

first control means for operating said process means, and, responsive to occurrence of trouble relating to the recording member, for interrupting the operation of said process means, said first control means including a control circuit having a memory which stores a program for the image forming operation; and second control means for discriminating the state change of said power switch means from the on-state to the off-state by said program and for controlling the start of the image forming operation, said second control means including detecting means for detecting the state of said power switch means and means for supplying a signal from said detecting means to said control circuit.

33. An apparatus according to claim 32, wherein said second control means discriminates, at the time of an interruption, the state of said power switch means to control the possibility of resuming the image forming operation.

34. An apparatus according to claim 32, wherein said second control means discriminates that said power switch means has been turned on again, and then enables said apparatus to resume the image forming operation.

35. An apparatus according to claim 32, further comprising means for locking the interruption, and a releasing switch for releasing the locking means, wherein said second control means enables said apparatus to resume the image forming operation in accordance with the state of said power switch means and the state of said releasing switch.

36. An apparatus according to claim 32, wherein said power switch means comprises at least one safety switch and a manually actuatable main switch.

37. An apparatus according to claim 32, further comprising means for indicating, upon an interruption, the place where the trouble has occurred.

38. An apparatus according to claim 32, wherein said power switch means comprises a plurality of safety switches located at different places.

39. An image forming apparatus, comprising:

process means for forming an image on a recording member;

power switch means for supplying power to said image forming apparatus;

first control means for operating said process means, and, responsive to the occurrence of trouble relating to the recording member, for interrupting the operation of said process means, said first-control means including a control circuit having a memory which stores a program for the image forming operation; and second control means for discriminating the state of said power switch means by said program and for controlling the image forming operation, said second control means including detecting means for detecting the state of said power switch means and means for connecting said detecting means to a predetermined bit port of said control circuit for performing a bit check by said program.

40. An apparatus according to claim 39, wherein said second control means discriminates, for its control of said apparatus, the turn-off state of said power switch means.

41. An apparatus according to claim 39, wherein said second control means discriminates, at the time of an interruption, the state of said power switch means to control the possibility of resuming the image forming operation.

42. An apparatus according to claim 39, further comprising means for locking the interruption, and a releasing switch for releasing the locking means, wherein said second control means enables said apparatus to resume the image forming operation in accordance with the state of said power switch means and the state of said releasing switch.

43. An apparatus according to claim 39, further comprising means for indicating, upon an interruption, the place where the trouble has occurred.

44. An apparatus according to claim 39, further comprising setting means for setting instructions for repetitive image forming operations, wherein said second control means controls the indication of the instructions set by said setting means, and a warning of a malfunction.

* * * * *